US010729972B2

(12) United States Patent
Gomez

(10) Patent No.: US 10,729,972 B2
(45) Date of Patent: Aug. 4, 2020

(54) BALL LAUNCHING GUIDE ASSEMBLY FOR AN AMUSEMENT GAME DEVICE

(71) Applicant: Stern Pinball, Inc., Elk Grove Village, IL (US)

(72) Inventor: George Gomez, Chicago, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 0 days.

(21) Appl. No.: 15/939,852

(22) Filed: Mar. 29, 2018

(65) Prior Publication Data

US 2018/0290050 A1 Oct. 11, 2018

Related U.S. Application Data

(60) Provisional application No. 62/479,593, filed on Mar. 31, 2017.

(51) Int. Cl.

| | |
|---|---|
| ***A63F 7/02*** | (2006.01) |
| ***A63F 7/30*** | (2006.01) |
| ***A63F 7/34*** | (2006.01) |

(52) U.S. Cl.

CPC ..... *A63F 7/027* (2013.01); *A63F 7/30* (2013.01); *A63F 2007/3025* (2013.01);

(Continued)

(58) Field of Classification Search

CPC ..... A63F 7/30; A63F 7/00; A63F 7/02; A63F 7/027; A63F 7/388

See application file for complete search history.

(56) References Cited

U.S. PATENT DOCUMENTS 1,595,071 A * 8/1926 Carlson ..... A63F 7/388 273/110

3,794,324 A * 2/1974 Moe ..... A63B 67/10 273/352

(Continued)

OTHER PUBLICATIONS

Zaccaria; Farfalla manual; pp. 21-29, 39-48, electrical diagrams, 1983, Zaccaria.†

(Continued)

*Primary Examiner* — Eugene L Kim
*Assistant Examiner* — Christopher Glenn
(74) *Attorney, Agent, or Firm* — Greenberg Traurig, LLP

(57) ABSTRACT

A front cabinet panel piece, a back panel cabinet piece, a first side cabinet panel piece, and second side cabinet panel piece, each having a plurality of pre-formed openings, are arranged relative to one another to form an amusement game cabinet. The plurality of pre-formed openings are used to accept a corresponding plurality of knock-down hardware pieces each including a fastener locking component and a fastener. The fastener locking components are held within respective first ones of the pre-formed openings and the fastener is inserted into second ones of the pre-formed openings that are aligned with the first ones of the plurality of pre-formed openings. Each fastener is mated to its corresponding fastener locking component to complete assembly of the amusement game cabinet. The assembled amusement game cabinet is used to support a playfield and the playfield, in turn, is used to provide additional structural support to the amusement game cabinet.

9 Claims, 4 Drawing Sheets

(52) U.S. Cl.
CPC ... *A63F 2007/341* (2013.01); *A63F 2007/346* (2013.01); *A63F 2007/348* (2013.01)

(56) References Cited

U.S. PATENT DOCUMENTS 4,595,202 A * 6/1986 Torgow ..... A63F 7/0058 273/122 A
4,620,706 A * 11/1986 Ijidakinro ..... A63F 7/027 273/122 R
4,746,121 A * 5/1988 David ..... A63F 7/388 273/110
4,822,045 A * 4/1989 Shoemaker, Jr. ..... A63F 7/388 273/110
4,861,037 A * 8/1989 Oursler ..... A63F 7/027 273/121 D
4,934,699 A * 6/1990 Kaminkow ..... A63F 7/3065 273/121 A
4,968,031 A * 11/1990 Kaminkow ..... A63F 7/027 273/119 A
5,002,279 A * 3/1991 Kaminkow ..... A63F 7/027 273/119 A
5,110,617 A * 5/1992 Gundling ..... A63F 7/027 427/181
5,112,049 A * 5/1992 Borg ..... A63F 7/027 273/118 R
5,158,292 A * 10/1992 Hanchar ..... A63F 7/3065 273/121 A
5,284,342 A * 2/1994 Tanzer ..... A63F 7/027 273/121 A
5,332,217 A * 7/1994 Gottlieb ..... A63F 7/027 273/121 A
5,356,141 A * 10/1994 Oursler ..... A63F 7/027 273/118 D
5,496,030 A * 3/1996 Fernandez ..... A63F 7/3075 273/119 A
5,507,487 A * 4/1996 Hansen ..... A63F 7/027 273/118 R
5,507,488 A * 4/1996 Eddy ..... A63F 7/027 273/118 A
5,533,726 A * 7/1996 Nordman ..... A63F 7/027 273/119 R
5,797,600 A 8/1998 Cebula et al.
5,899,454 A * 5/1999 Eddy ..... A63F 7/3075 273/127 C
6,805,348 B1 * 10/2004 Chen ..... A63F 7/0608 273/108.32
2005/0073092 A1 * 4/2005 Oister ..... A63F 7/025 273/119 R

OTHER PUBLICATIONS

Zaccaria; Zankor manual; pp. 21-29, 39-48, electrical diagrams; 1986; Zaccaria.†
Sega Pinball, Inc.; Baywatch manual; 1995; Sega Pinball, Inc.†
Sega Pinball, Inc.; Apollo 13 Manual; 1995; Sega Pinball, Inc.†

* cited by examiner
† cited by third party

BALL LAUNCHING GUIDE ASSEMBLY FOR AN AMUSEMENT GAME DEVICE

CROSS REFERENCE TO RELATED APPLICATION

This application is a non-provisional application claiming priority from U.S. Provisional Application Ser. No. 62/479,593, filed Mar. 31, 2017.

BACKGROUND

Amusement game devices, such as pinball machines, are well known in the art. By way of example, U.S. Pat. No. 5,797,600, which is incorporated herein by reference in its entirety, illustrates and describes an amusement game device of the type having a cabinet which houses a playfield where the playfield includes various types of targets that are intended to be interacted with by a ball to achieve one or more game objectives. For storing the balls that are to be used during game play, the cabinet is typically provided with a main ball trough and a ball is launched out of the main ball trough by a solenoid into a ball launching alley or chute to a ball launching position where the ball will be in front of a ball launching device. As still further illustrated and described in U.S. Pat. No. 5,797,600, when the ball is placed into the ball launching position adjacent to the ball launching device, the ball rests in a machined groove in the playfield, which is generally referred to in the art as a "shooter groove." The shooter groove centers the ball in a position to allow the ball launching device to impart a force onto the ball that is sufficient to put the ball into play upon the playfield, i.e., a force that is sufficient to cause the ball to be exited from the ball launching alley.

In operation, the shooter grove is intended to guide the ball smoothly as it moves thru the ball launching alley and onto the playfield. However, it has been seen that repeated launches of the ball can result in the shooter groove becoming damaged. Specifically, it has been seen that the protective hardcoat that is typically provided to the surface of the playfield becomes damaged at the point(s) where the ball impacts the edges of the shooter groove as the ball is being directed towards the playfield. When the protective hardcoat is damaged in this manner, the integrity of the playfield surface is compromised and a costly repair of the damaged area and/or a replacement of the entire playfield are the only known solutions to correct this problem.

SUMMARY

To address at least the above described problem, the following describes an amusement game having a game cabinet, an inclined playfield mounted within the game cabinet, where the playfield defines a game play area having one or more elements to be interacted with by a ball and a ball launching alley from which the ball is moved onto the game play area, and a ball launching device having a ball striking element for launching the ball from the ball launching alley onto the game play area of the playfield. A ball launching guide assembly is disposed within the ball launching alley and is arranged to provide a separation between the ball and a surface of the ball launching alley of the playfield in an area of the ball launching alley that is at least positioned adjacent to ball striking component of the ball launching device.

Preferably, the ball launching guide assembly comprises a pair of spaced apart rails that are releasably mounted to the playfield in the ball launching alley and which extend a distance from an area adjacent to the ball striking component of the ball launching device towards the game play area of the playfield.

Still further, the ends of the spaced apart rails opposite the ball launching device preferably diverge to provide a funnel for returning the ball, when launched with a force insufficient to place the ball onto the game play area, to a ball launching position adjacent to the ball striking component of the ball launching device.

A better understanding of the objects, advantages, features, properties and relationships of the subject ball launching guide will be obtained from the following detailed description and accompanying drawings which set forth illustrative embodiments which are indicative of the various ways in which the principles of the ball launching guide assembly may be employed.

BRIEF DESCRIPTION OF THE DRAWINGS

For a better understanding of the ball launching guide assembly described hereinafter reference may be had to the following drawings in which.

DETAILED DESCRIPTION

With reference to the figures, an amusement game device, in the exemplary form of a pinball machine 10 is now described. It is to be appreciated, however, that this exemplary form for the amusement game device 10 is not intended to be limiting. Rather, those of ordinary skill in the art will appreciated that the assembly described hereinafter can be utilized in any type of amusement game device of the commercial and non-commercial type in which it is desired to launch a ball, particularly a steel ball, onto a playfield.

Figure 1:
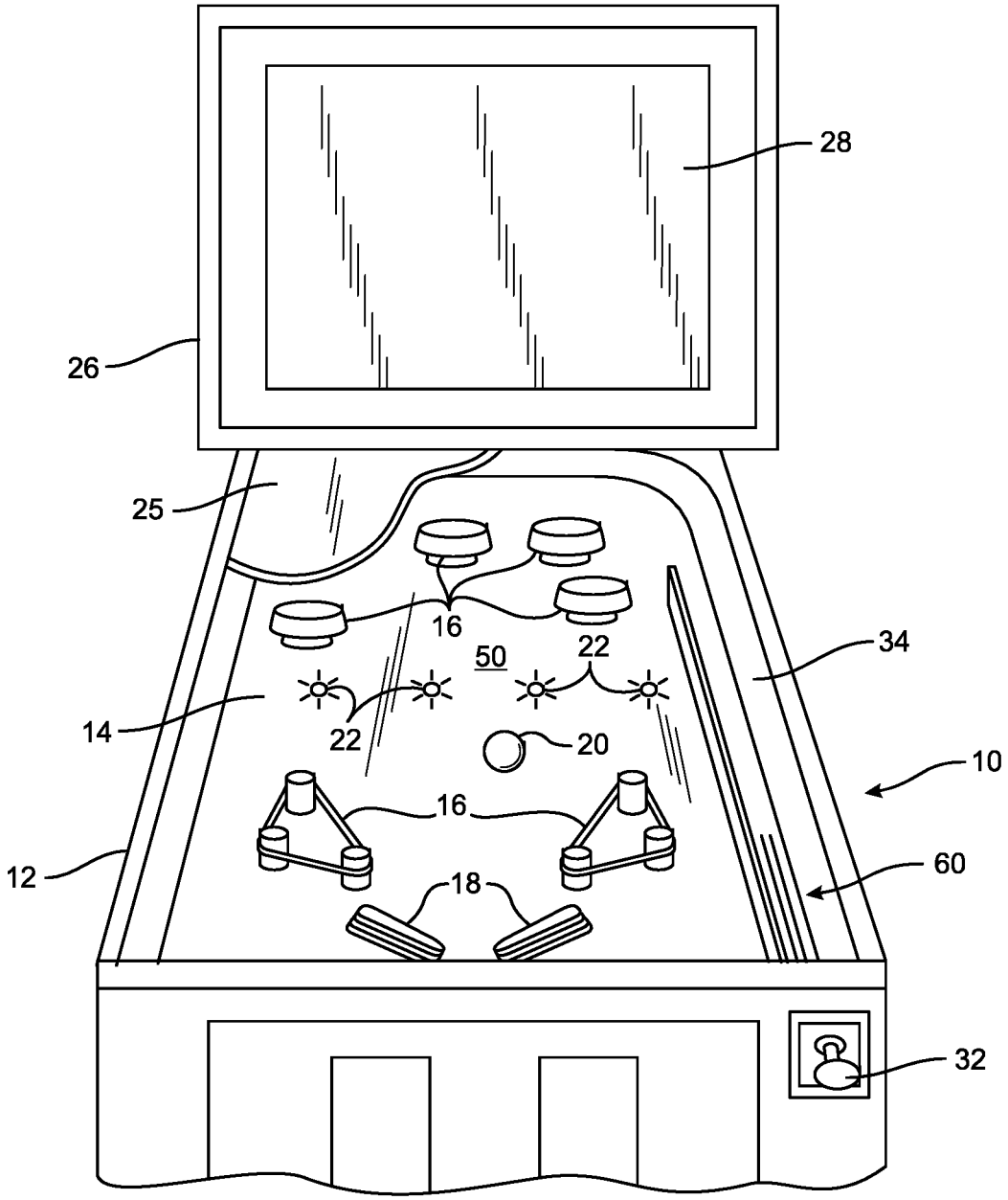
FIG. 1 illustrates an exemplary amusement game device in the form of a pinball machine.

In keeping with the example of an amusement game device 10 of the pinball machine type, the amusement game device 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. Upon activation of the game in this manner, game play, in the case of a pinball machine, is defined upon an inclined playfield 14, typically constructed from wood and having a protective surface coating applied thereto, that supports a number of playfield accessories or devices. More particularly, in the case of a pinball machine, game play is generally defined through the use of a pair of flippers 18 to propel a ball 20 relative to a game play area of the playfield 14 and input devices/accessories associated with the game play area of the playfield 14. The playfield 14 is usually inclined from the horizontal such that the ball tends to eventually roll back down the playfield 14 in the direction of the flippers 18. While not intended to be limiting, the playfield accessories 16 may include elements such as bumpers, ramps, and/or targets. The playfield 14 may be covered by a transparent or glass sheet cover 25 to permit viewing of the playfield 14. In addition to the foregoing, the playfield 14 includes a ball launching device (which may be a manually controlled plunger 32 as illustrated, solenoid operated plunger, or the like as required) which shoots the ball 20 from a ball launching position that is adjacent to the ball launching device up a ball launching alley 34 into the play area of the playfield 14. The playfield 14 may also include lighting elements 22 and/or other features as desired. Other player-activated input elements, typically in the form of push-buttons on the sides of the cabinet 12, are usually provided for controlling operation of the flippers 18 and, in some instances, to control operation of the ball launching device. The amusement game 10 may also include a backbox 26 which is mounted to overlay a top rear portion of the cabinet 12 and which contains a game display 28, such as a dot matrix display, CRT, LED or plasma display, or the like. The backbox 26 may also support speakers associated with the game sound system. Within the backbox 26 may be located various ones of the electronic devices/circuits for controlling the operation of the playfield devices, the display, general illumination, and the sound system. Such electronic devices/circuits could also, in whole or in part, be carried within the game cabinet 12.

For protecting the playfield 14 during ball launching events initiated by the ball launching device, the ball launching alley 34 is provided with a ball launching guide assembly 60 as shown in FIGS. 2-5. Generally, the ball launching guide assembly 60 is comprised of a pair of opposed wire-frame rails 62A and 62B that are positioned and arranged to maintain the ball elevated a distance above the surface of the playfield 14 when the ball 20 is in at least the ball launching position that is adjacent to the ball sticking component 61 of the ball launching device. In certain circumstances, for example in the case of a manually operated plunger 32 that may be withdrawn to compress a spring that is, in turn, coupled to the ball sticking component 61 of the ball launching device, the rails 62A and 62B may extend towards the front of the cabinet from the position in which the ball 20 is initially deposited into the ball launching alley 34 from a ball holding trough 63 or the like. While not required, it is preferred that the bottom portions of rails 62A and 62B be disposed flush upon the surface of the playfield 14 and that the diameter D3 of the rails 62A and 62B (or height/width in the case of non-circular rails) and the distance D1 between the rails be selected considering the diameter D2 of the ball so as to minimize the distance by which the ball 20 is elevated above/separated from the playfield 14 to thereby allow the ball launching guide assembly 60 to be used with existing ball launching device configurations, i.e., to ensure that the ball striking component 61 of the ball launching device will remain generally centered on the ball 20.

Figure 2:
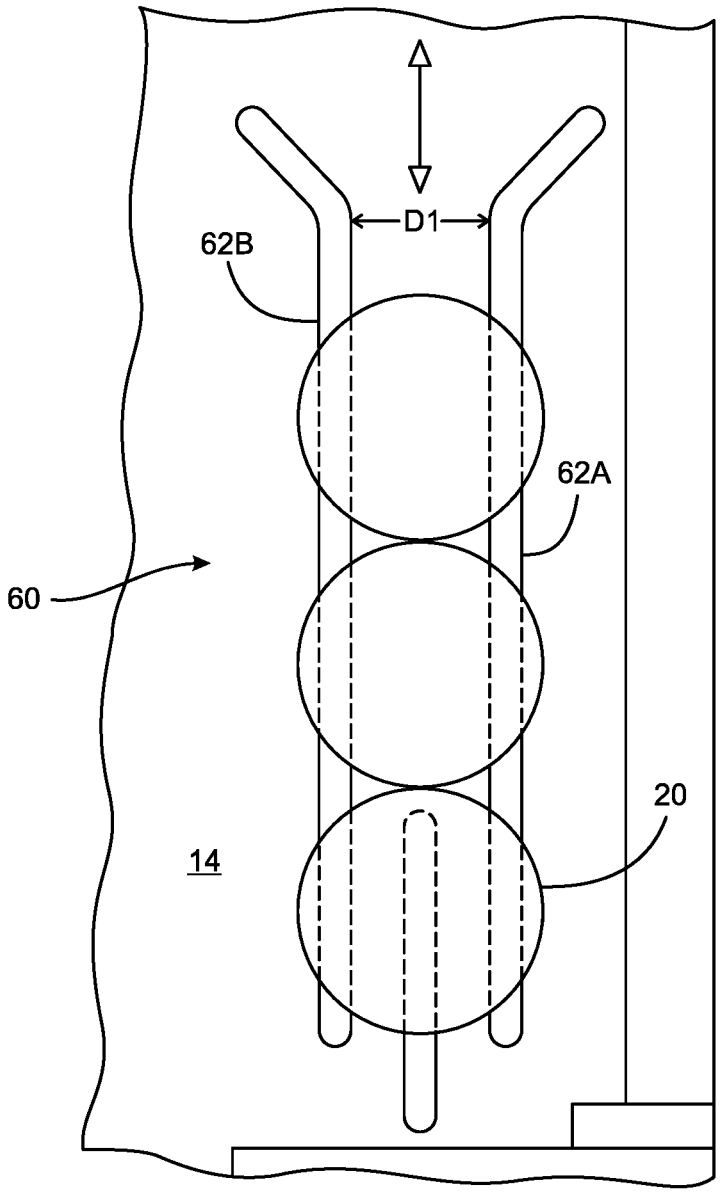
FIG. 2 illustrates a top view of a ball launching guide assembly of the pinball machine of FIG. 1 constructed according to the description which follows.

To ensure that the ball 20 does not get caught up on the ends of the rails 62A and 62B in the case where the ball 20 rolls back down the ball launching alley 34 after being launched by the ball launching device with a force that is merely sufficient for the ball 20 to be moved beyond the ends of the ball launching assembly 60, the ends of the rails 62A and 62B are arranged to diverge away from each other as shown in FIG. 2. As will be appreciated, with this arrangement, as the ball 20 rolls back down the rail, the ball 20 will be funneled back onto the rails 62A and 62B while being lifted off of the playfield surface 14 by the rails 62A and 62B owing to the interaction between the curved surface of the ball 20 and the narrowing distance between the rails 62A and 62B in the direction that extends back towards the ball launching device. It will also be appreciated that the ends of the rails 62A and 62B could be provided with a top surface that is inclined towards the playfield 13 to assist in lifting the ball 20 back onto the rails 62A and 62B in the event that the ball 20 is launched with insufficient force to clear the ball launching alley 34.

Figure 3:
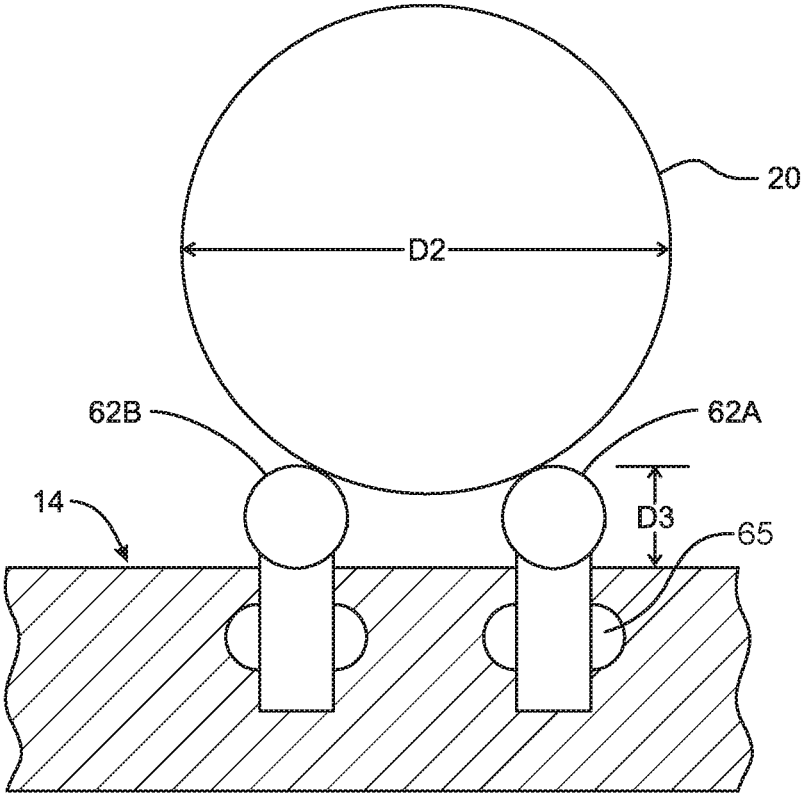
FIG. 3 illustrates a cross-sectional view of the ball launching guide assembly of FIG. 2.
Figure 4:
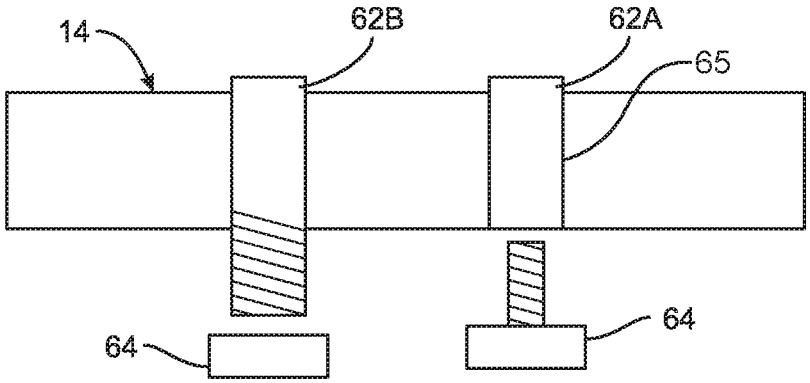
FIG. 4 illustrates further examples of the ball launching guide assembly of FIG. 2 being releasably attached to a playfield of the pinball machine of FIG. 1.
Figure 5:
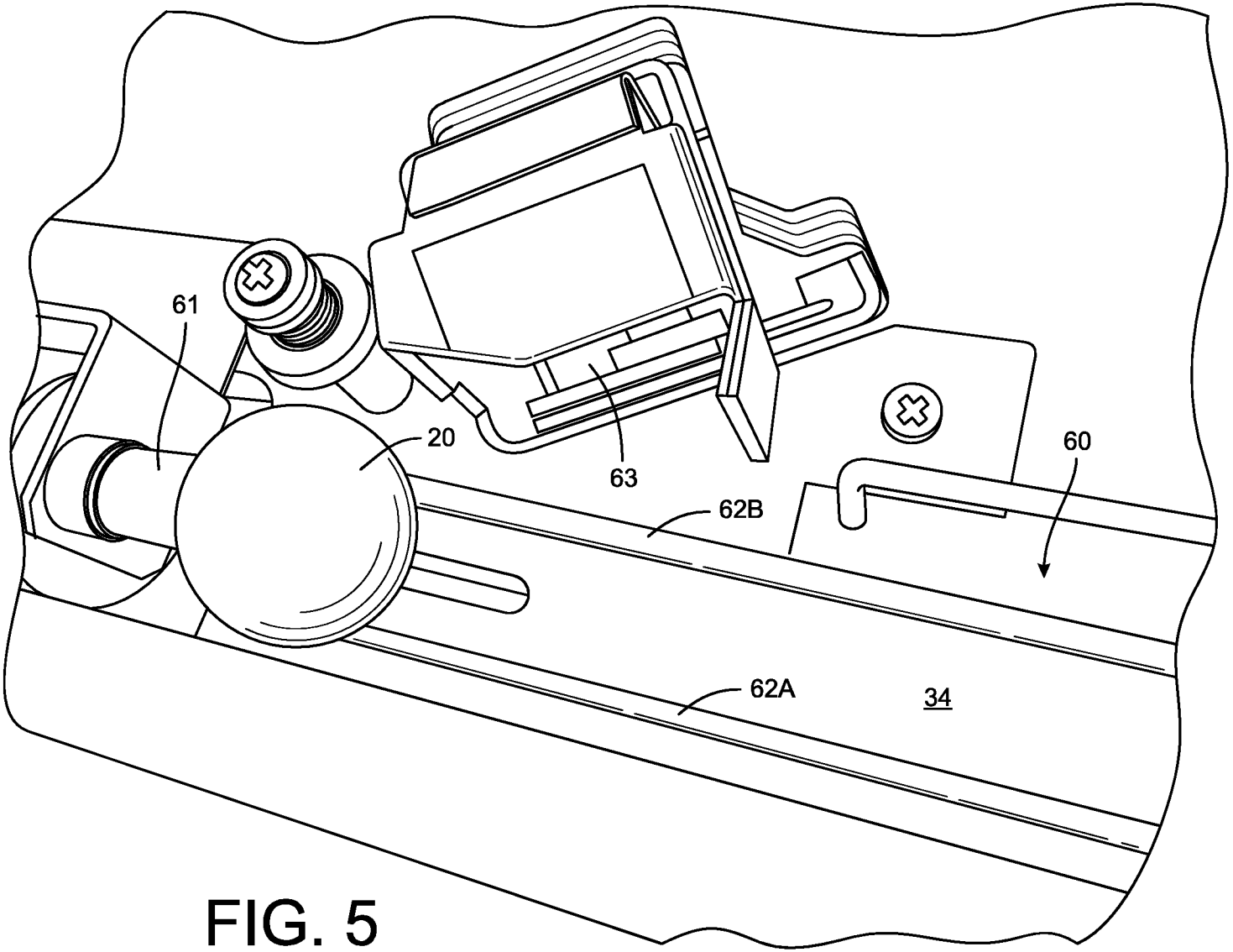
FIG. 5 also illustrates a top view of a ball launching guide assembly of the pinball machine of FIG. 1 constructed according to the description which follows.

To removably attach the rails 62A and 62B to the playfield 14, it is contemplated that the rails 62A and 62B can be press fit or friction fit into holes 65 that are formed in the playfield 14 as shown in FIG. 3. It is also contemplated that rails 62A and 62B could be press fit or friction fit into plastic inserts for the like which inserts are, in turn, positioned within holes that are formed in the playfield 14. Still further, it is contemplated that the ends of the rails 62A and 62B could be provided with threads (whether internal or external) to cooperate with a fastening device 64 retained within the holes 65 as illustrated in FIG. 4. In still further instances, the ends of the rails 62A and 62B could be bent against the bottom side of the playfield 14 to attach the rails 62A and 62B to the playfield. It is to be understood that these described methods for attaching the rails 62A and 62B to the playfield 14 are not intended to be limiting and that those of skill in the art will readily appreciate that still further attachment mechanisms may be used to achieve this same purpose.

In some circumstances, the rails 62A and 62B may also be provided with a coating or be constructed from a material to prevent metal on metal rubbing between the rails 62A and 62B and the ball as desired.

While a specific embodiment of the ball guide assembly has been described in detail, it will be appreciated by those skilled in the art that various modifications and alternatives to those details could be developed in light of the overall teachings of the disclosure. For example, the ball guide assembly may be constructed using one or more formed plates that are positioned on the playfield in the ball launching alley to achieve the same results described herein. Accordingly, the particular arrangement disclosed is meant to be illustrative only and not limiting as to the scope of the invention which is to be given the full breadth of the appended claims and any equivalents thereof.

What is claimed is:

1. An amusement game, comprising:

a game cabinet;

an inclined playfield mounted within the game cabinet wherein a surface of the playfield comprises a game play area having one or more elements to be interacted with by a ball and a ball launching alley from which the ball is moved into the game play area;

a ball launching device having a ball striking component for launching the ball from the ball launching alley into the game play area; and a ball launching guide assembly comprising a pair of spaced apart rails and disposed within the ball launching alley, a bottom portion of each of the spaced apart rails disposed flush upon the surface of the playfield, wherein a first portion of the ball launching guide assembly is arranged to provide a separation between the ball and the surface of the playfield in at least a portion of the ball launching alley that is positioned adjacent to the ball striking component of the ball launching device and a second portion of the ball launching guide assembly is arranged to gradually reduce the separation between the ball and the surface of playfield as the ball moves away from the ball striking component and towards the game play area, wherein the pair of spaced apart rails that form the second portion of the ball launching guide diverge to provide a funnel for gradually lowering the ball towards the surface of the playfield and for gradually raising the ball from the surface of the playfield and returning the ball, when launched off of the ball launching guide assembly with a force insufficient to place the ball into the game play area, to the area adjacent to the ball striking component of the ball launching device, and wherein ends of the pair of spaced apart rails pass through holes formed in the surface of the playfield, the ends of the pair of spaced apart rails are provided with threads, and corresponding threaded fasteners having a surface for engaging an opposite surface of the playfield are used to attach the ball launching guide assembly to the surface of the playfield.

2. The amusement game as recited in claim 1, wherein the ball launching guide assembly is releasably coupled to the surface of the playfield.

3. The amusement game as recited in claim 2, wherein the pair of spaced apart rails are press fit into the holes formed in the surface of the playfield.

4. The amusement game as recited in claim 1, wherein the ends of the pair of spaced apart rails are provided with external threads.

5. The amusement game as recited in claim 1, wherein the ends of the spaced apart rails are provided with internal threads.

6. The amusement game as recited in claim 1, wherein the pair of spaced apart rails are constructed from a metallic material.

7. The amusement game as recited in claim 6, wherein the ball is also constructed from a metallic material and the metallic material of the pair of spaced apart rails is coated at least in part with a material to prevent metal on metal rubbing between the pair of spaced apart rails and the ball.

8. The amusement game as recited in claim 1, wherein each of the pair of spaced apart rails is provided with at least a first size characteristic and are spaced apart by a distance that are both selected to minimize the separation between the ball and the surface of the playfield in at least a portion of the ball launching alley that is positioned immediately adjacent to the ball striking component of the ball launching device.

9. An amusement game, comprising:

a game cabinet;

an inclined playfield mounted within the game cabinet wherein a surface of the playfield comprises a game play area having one or more elements to be interacted with by a ball and a ball launching alley from which the ball is moved into the game play area;

a ball launching device having a ball striking component for launching the ball from the ball launching alley into the game play area; and a ball launching guide assembly comprising a pair of spaced apart rails and disposed within the ball launching alley, a bottom portion of each of the spaced apart rails disposed flush upon the surface of the playfield, wherein a first portion of the ball launching guide assembly is arranged to provide a separation between the ball and the surface of the playfield in at least a portion of the ball launching alley that is positioned adjacent to the ball striking component of the ball launching device and a second portion of the ball launching guide assembly is arranged to gradually reduce the separation between the ball and the surface of playfield as the ball moves away from the ball striking component and towards the game play area, wherein the pair of spaced apart rails that form the second portion of the ball launching guide provide a pair of ball supporting surfaces that are inclined towards the surface of the playfield for gradually lowering the ball towards the surface of the playfield and for gradually raising the ball from the surface of the playfield and returning the ball, when launched off of the ball launching guide assembly with a force insufficient to place the ball onto the game play area, to the area adjacent to the ball striking component of the ball launching device, and wherein ends of the pair of spaced apart rails pass through holes formed in the surface of the playfield, the ends of the pair of spaced apart rails are provided with threads, and corresponding threaded fasteners having a surface for engaging an opposite surface of the playfield are used to attach the ball launching guide assembly to the surface of the playfield.

* * * * *